US006745657B2

(12) United States Patent
Nagasawa

(10) Patent No.: US 6,745,657 B2
(45) Date of Patent: Jun. 8, 2004

(54) SHEET FEEDING DEVICE AND IMAGE FORMING APPARATUS USING THE SAME

(75) Inventor: Minoru Nagasawa, Kitakatsushika-gun (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/180,317

(22) Filed: Jun. 27, 2002

(65) Prior Publication Data

US 2003/0010169 A1 Jan. 16, 2003

(30) Foreign Application Priority Data

Jun. 27, 2001 (JP) ..... 2001-193987
May 21, 2002 (JP) ..... 2002-145935

(51) Int. Cl.[7] ..... B26D 5/20; B41J 11/70

(52) U.S. Cl. ..... 83/220; 83/614; 399/385; 242/563

(58) Field of Search ..... 83/614, 368, 367, 83/210, 211, 370, 220, 221, 240, 734; 399/385, 386, 387, 365, 367; 242/558, 563, 563.1; 226/49

(56) References Cited

U.S. PATENT DOCUMENTS 5,596,916 A * 1/1997 Gallagher et al. ..... 83/367
6,185,403 B1 2/2001 Toyoshima et al.
6,260,457 B1 * 7/2001 Hakkaku ..... 83/614

FOREIGN PATENT DOCUMENTS

| | | | |
|---|---|---|---|
| DE | 019931899 | * | 3/2000 |
| JP | 08-012148 | | 1/1996 |
| JP | 408091658 | * | 4/1996 |
| JP | 10-129900 | | 5/1998 |

* cited by examiner

*Primary Examiner*—Stephen Choi
(74) *Attorney, Agent, or Firm*—Oblon, Spivak, McClelland, Maier & Neustadt, P.C.

(57) ABSTRACT

A sheet feeding device of the present invention includes a cutter capable of being moved back and forth by hand between two reference positions outside of a sheet conveyance range. When the cutter is held in a halt at a position other than the reference positions, the sheet feeding device returns a sheet toward the upstream side by a preselected amount and then returns the cutter to one of the reference positions. Even when the cutter moved by hand for the replacement or the replenishment of a sheet is left in the sheet conveyance range, the cutter is prevented from again cutting the leading edge of the sheet when returning to the reference position. This protects the leading edge of the sheet from defective cutting.

5 Claims, 4 Drawing Sheets

SHEET FEEDING DEVICE AND IMAGE FORMING APPARATUS USING THE SAME

BACKGROUND OF THE INVENTION

1. Field of the Invention

The present invention relates to a sheet feeding device for cutting an elongate sheet paid out from a roll at a preselected length and conveying the cut sheet and an image forming apparatus using the same.

2. Description of the Background Art

Generally, an image forming apparatus of the type using an elongate sheet implemented as a roll uses either one of a guillotine type cutter and a rotary type cutter for cutting the sheet. Japanese Patent Laid-Open Publication Nos. 11-48553 and 6-278938, for example, each discloses a cutter in the form of a rotary edge movable back and forth in the widthwise direction of a sheet.

An image forming apparatus of the type using a rotary edge mentioned above may be configured to allow the operator of the apparatus to move the cutter by hand for the replacement or the replenishment of a sheet after opening the cover of a sheet storing section and turning off a power switch, as proposed in the past. By moving the cutter in the widthwise direction of a sheet by hand, the operator can cut the leading edge of a new sheet replaced or replenished at a preselected position. In this type of image forming apparatus, after the operator has cut the leading edge of the new sheet, closed the cover of a sheet storing section and then turned on a power switch, the cutter is automatically returned to a reference position outside of a sheet conveyance range by power. This is because the operator may have left the cutter within the sheet conveyance range.

To return the cutter to the reference position, two cutter sensors are positioned at opposite reference positions outside of the sheet conveyance range. Whether or not the cutter has been returned to the reference position is determined on the basis of the output signals of the two cutter sensors. If the answer of this decision is negative, then control is executed to return the cutter to the reference position outside of the sheet conveyance range.

The conventional image forming apparatus of the type described has the following problem left unsolved. Assume that the operator cut the leading edge of a new sheet by moving the cutter by hand leaves the cutter at a position within the sheet conveyance range. Then, after the operator has closed the cover of the sheet storing section and then turned on the power switch, the cutter is automatically moved to the reference position and therefore again cuts the leading edge of the sheet already cut by the manual operation. The cutter can accurately cut a sheet when the portion of the sheet to be cut is remote from the leading edge by a preselected dimension. However, when the cutter is automatically moved along the edge of the sheet already cut by manual operation, the edge of the sheet moves relative to the cutter and is therefore folded or bent due to interference with the cutter or is only partly cut in the widthwise direction. As a result, the leading edge of the sheet cut by the cutter is defective.

Technologies relating to the present invention are also disclosed in, e.g., Japanese Patent Laid-Open Publication Nos. 8-12148 and 10-129900.

SUMMARY OF THE INVENTION

It is an object of the present invention to provide a sheet feeding device capable of preventing, even when a cutter is left in a sheet conveyance range after the replacement or the replenishment of a roll, the cutter from again cutting the leading edge of a sheet when returning to a reference position for thereby obviating defective cuffing, and an image forming apparatus using the same.

A sheet feeding device of the present invention includes a sheet storing section configured to store an elongate sheet implemented as a roll. The sheet paid out from the sheet storing section is conveyed to a preselected position via an outlet. Feed members are driven by a reversible feed motor for feeding the sheet via the outlet. A cutter is capable of being moved back and forth by hand between two reference positions located outside of and opposite sides of the widthwise range of the sheet. A drive section causes the cutter to move back and forth with power. A position recognizing device recognizes a position where the cutter is held in a halt. When the position recognizing device determines that the cutter is held in a halt at a position other than the reference positions, a reverse conveying device causes the feed members to return the leading edge of the sheet toward the upstream side in the direction sheet feed over the cutter by a preselected amount. Further, when the position recognizing device determines that the cutter is held in a halt at a position other than the reference positions, a returning device causes the drive section to return the cutter to either one of the reference positions after the reverse conveying device has returned the sheet.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
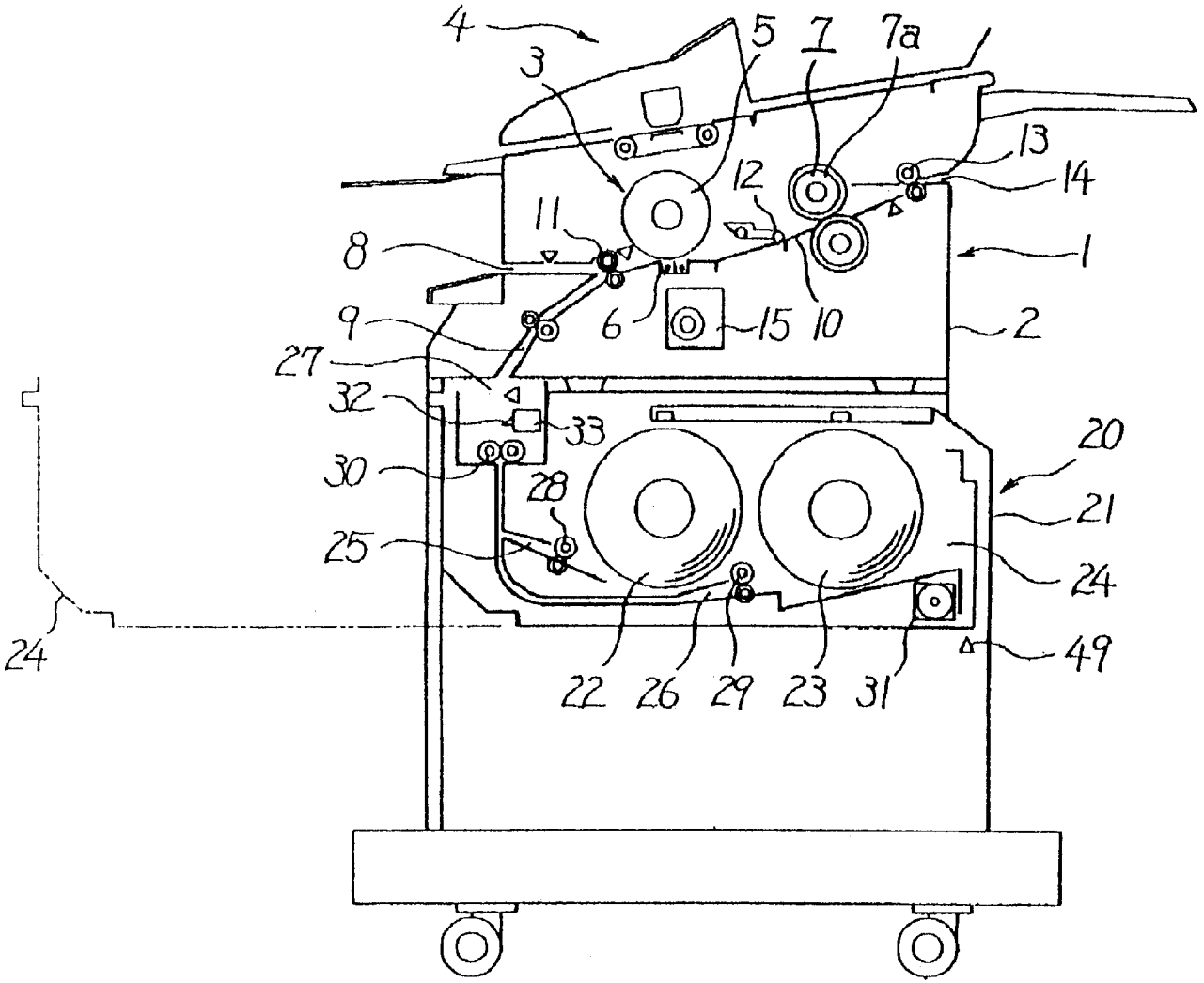
FIG. 1 is a sectional side elevation showing an image forming apparatus including a sheet feeding device embodying the present invention.

Referring to FIG. 1 of the drawings, an image forming apparatus embodying the present invention is shown and implemented as an electrophotographic copier by way of example. As shown, the image forming apparatus, generally 1, includes a casing 2 accommodating an image forming section 3 therein. An ADF (Automatic Document Feeder) 4 is mounted on the top of the casing 2 although it is not essential with the present invention. The image forming section 3 includes a photoconductive drum 5, which is a specific form of an image carrier. Arranged around the drum 5 are a plurality of conventional process units, not shown, for charging the drum 5, forming a latent image on the drum 5, developing the latent image, cleaning the drum 5, and discharging the drum. An image transferring unit 6 also adjoins the drum 5 for transferring a developed image or toner image from the drum 5 to a sheet or recording medium. A fixing unit 7 is positioned downstream of the image transferring unit 6 in the direction of sheet conveyance and fixes the toner image on the sheet.

The drum 5 and image transferring unit 6 face each other with the intermediary of a sheet path 10, which is connected to sheet paths 8 and 9 at the upstream side in the direction of sheet conveyance. A registration roller pair 11 is positioned on the sheet path 10 upstream of the drum 5 in the direction of sheet conveyance. A press roller 12 for pressing the sheet is positioned upstream of the fixing unit 7 in the direction of sheet conveyance while an outlet roller pair 13 is positioned downstream of the fixing unit 7 in the above direction. The sheet path 10 terminates at an outlet 14 through which the sheet is driven out to a copy tray not shown. A single motor 15 rotates the drum 5, a heat roller 7*a* included in the fixing unit 7, a drive roller of the registration roller pair 11, and a drive roller of the outlet roller pair 13.

A sheet feeding device 20 for feeding a cut sheet to the image forming apparatus 1 will be described specifically hereinafter. The sheet feeding device 20 includes a sheet storing section 24 storing a plurality of sheets implemented as rolls 22 and 23. The sheets are paid out from the rolls 22 and 23 via feed paths 25 and 26, respectively. The sheet 22 or 23 is conveyed to a preselected position, i.e., the sheet path 9 of the image forming apparatus in the illustrative embodiment via an outlet 27. Feed roller pairs or feeding means 28 and 29 are positioned at the inlets of the feed paths 25 and 26, respectively. A roller pair or another feeding means 30 is positioned upstream of the outlet 27 in the direction sheet feed. A single reversible, feed motor 31 rotates drive rollers included in the roller pairs 28, 29 and 30. A cutter 32 for cutting the sheet 22 or 23 is positioned upstream of the outlet 27 and supported by a carrier 33. In the illustrative embodiment, the cutter 32 is implemented as a rotary edge.

Figure 2:
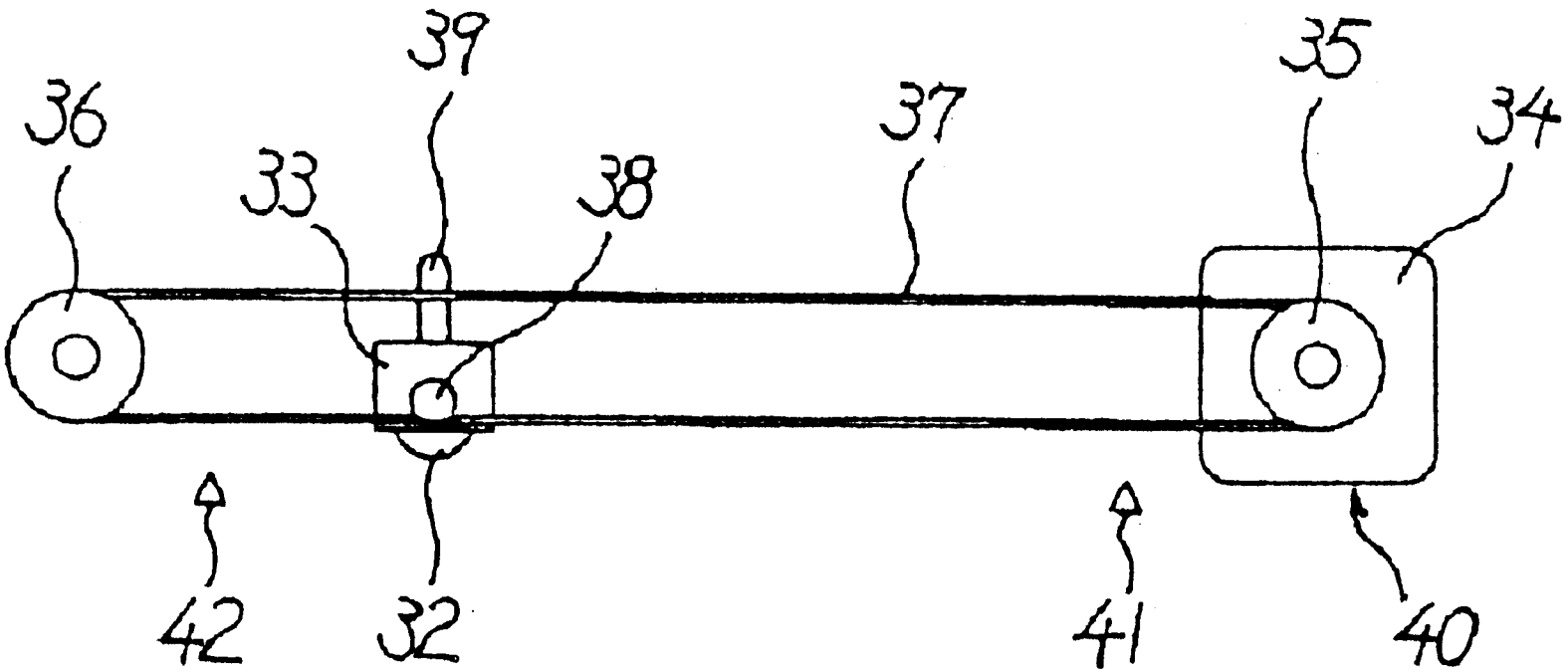
FIG. 2 is a front view of a drive arrangement for moving a cutter included in the illustrative embodiment back and forth.

As shown in FIG. 2, the carrier 33 supporting the cutter 32 is affixed to a belt 37 passed over a drive pulley 35 and a driven pulley 36. A reversible cutter motor 34 is drivably connected to the drive pulley 35. When the belt 37 linearly moves the carrier 33 back and forth, the linear movement of the carrier 33 is converted to rotary movement for thereby causing the cutter or rotary cutting edge to rotate. More specifically, a wheel 38 is freely rotatably mounted on the carrier 33 in such a manner as to be driven by the belt 37. The wheel 38 is directly or indirectly connected to the cutter 32 so as to transfer its rotation to the cutter 32. However, such a configuration is only illustrative. A knob 39 protrudes from the carrier 33 and allows the operator of the copier to move the carrier 33 by hand. The cutter motor 34, drive pulley 35, driven pulley 36, belt 37 and carrier 33 supporting the cutter 32 and wheel 38 constitute a drive section 40 for moving the cutter 32 back and forth.

A right sensor 41 and a left sensor 42 are positioned inward of the drive pulley 35 and driven pulley 36, respectively, as illustrated. The right sensor 41 and left sensor 42 are positioned outside of the maximum sheet width (sheet conveyance range) available with the sheet feeding device 20, i.e., the width of the sheet 22 or that of the sheet 23. When either one of the two sensors 41 and 42 senses the cutter 32, it outputs a sense signal showing that the cutter 32 exists at a preselected reference position outside of the sheet conveyance range. Therefore, two reference positions exist at both sides of the sheet conveyance range.

Figure 3:
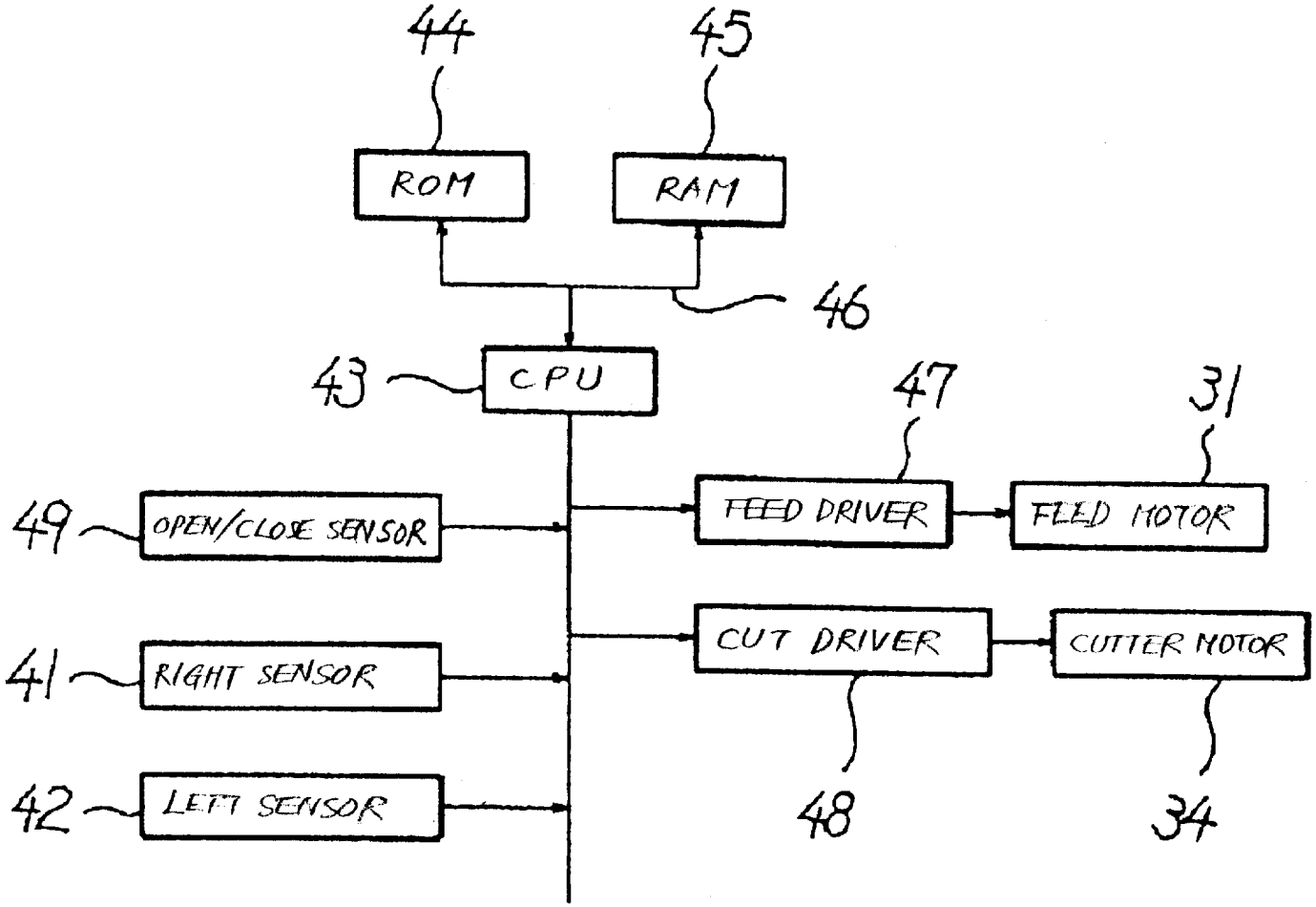
FIG. 3 is a schematic block diagram showing a control system included in the illustrative embodiment.

FIG. 3 shows a control system assigned to the sheet feeding device 20. As shown, the control system includes a CPU (Central Processing Unit) 43, a ROM (Read Only Memory) 44 storing a program and other fixed data to be executed by the CPU 43, and a RAM (Random Access Memory) 45 serving as a work area for the CPU 43. The CPU 43, ROM 44 and RAM 45 are interconnected by a system bus 46. Connected to the CPU 43 are the right sensor 41, the left sensor 42, a feed driver 47 for driving the feed motor 31, a cutter driver 48 for driving the cutter motor 34, and an open/close sensor 49.

The open/close sensor 49 outputs a signal showing whether or not the sheet storing section 24 is opened. More specifically, the sheet storing section 24 is movable between a closed position and an open position respectively indicated by a solid line and a phantom line in FIG. 1. The sheet storing section 24 is accommodated in the body 21 of the sheet feeding device 20 in the closed position or pulled out of the body 21 in the open position. When the sheet storing section 24 is pushed into the body 21, the open/close sensor 49 senses the sheet storing section 24 either mechanically or optically and outputs an electric sense signal. The right sensor 41 and left sensor 42 each are assumed to output an ON signal when sensing the cutter 32.

The operation of the illustrative embodiment will be described hereinafter. When the operator selects the sheet 22, the roller pairs 28 and 30 convey the sheet 22 to the sheet path 9 of the image forming apparatus 1 via the feed path 25. Likewise, when the operator selects the other sheets 23, the roller pairs 29 and 30 convey the sheet 23 to the sheet path 9 via the feed path 26 and the upper part of the feed path 25. In the image forming apparatus 1, the previously mentioned process units charge the surface of the drum 5, form a latent image on the charged surface of the drum 5, and develop the latent image with toner to thereby produce a corresponding toner image. Subsequently, the image transferring unit 6 transfers the toner image from the drum 5 to the sheet 22 or 23. The sheet 22 or 23 carrying the toner image is conveyed to the fixing unit 7 and has the toner image fixed thereby. After the cutter 32 has cut the sheet 22 or 23 at a preselected length, the resulting cut sheet or print is driven out to the copy tray via the outlet 14 by the outlet roller pair 13.

More specifically, to cut the sheet 22 or 23, the cutter motor 34 is driven to move the carrier 33 supporting the cutter 32 from one reference position to the other reference position. At this instant, the cutter 32 is caused to rotate for thereby cutting the sheet 22 or 23. In the illustrative embodiment, when a preselected period of time elapses since the time when the right sensor 41 or the left sensor 42 has output an ON signal, the cutter motor 34 is deenergized to stop the cutter 32 at the reference position outside of the left sensor 42 or the right sensor 41.

Assume that the operator pulls out the sheet storing section 24 to the open position (phantom line, FIG. 1) for the purpose of replacing or replenishing the sheet 22 or 23. At this time, the operator pays out a newly set sheet 22 or 23 from a roll to a position slightly downstream of the locus of movement of the cutter 32 in the direction of sheet feed. Subsequently, the operator grips the knob 39 and then moves the carrier 33 by hand to thereby cut are leading edge of the sheet 22 or 23. Thereafter, the operator pushes the sheet feeding section 24 into the body 21 to the closed position (solid line, FIG. 1).

Figure 4:
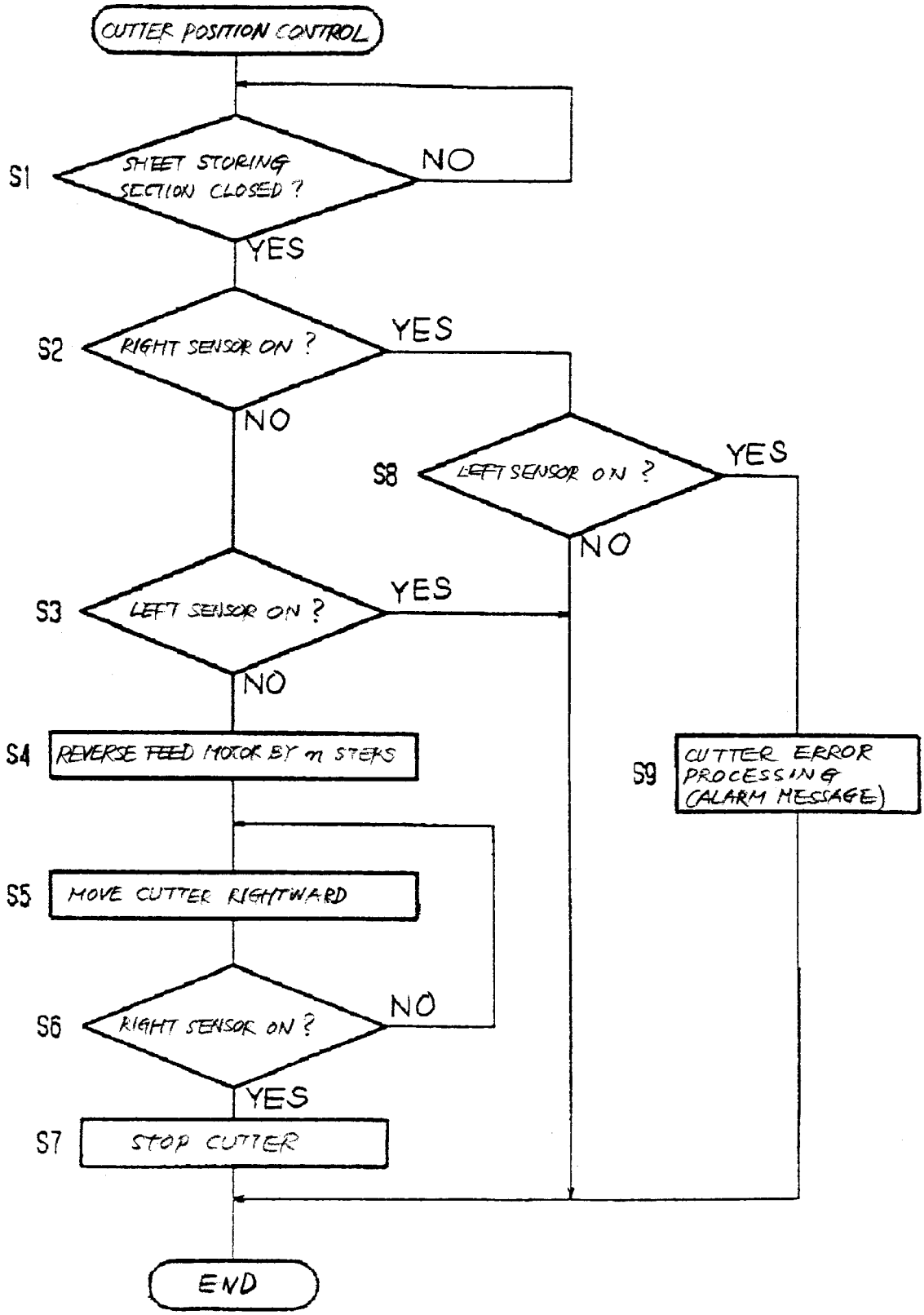
FIG. 4 is a flowchart demonstrating a specific operation of the illustrative embodiment.

Reference will be made to FIG. 4 for describing a cutter position control procedure to be executed after the operator has pushed the sheet storing section 24 into the body 21 to the closed position. After the operator has cut the leading edge of the sheet 22 or 23 by moving the cutter 32 by hand, as stated above, it is likely that the cutter 32 is left in the conveyance range assigned to the sheet 22 or 23. In light of this, the procedure first determines a position where the cutter 32 is held in a halt. More specifically, the CPU 43 references the output signal of the open/close sensor 49 to determine whether or not the sheet storing section 24 is held in the closed position (step S1). If the answer of the step S1 is positive (YES), then the CPU 43 references the output signals of the right sensor 41 and left sensor 42 to determine the position of the cutter 32 (steps S2, S3 and S8; position recognizing means).

Assume that the output signal of the right sensor 41 is not in an ON state (NO, step S2), and that the output signal of the left sensor 42 is not in an ON state (NO, step S3). This shows that the cutter 32 is not present at either one of the right and left reference positions, but is present in the sheet conveyance range. In this case, the CPU 43 drives the feed motor 31 by n steps in the reverse direction (step S4) to thereby rotate the roller pairs 28, 29 and 30 in the reverse direction. The number of steps n is selected such that the leading edge of the sheet 22 and 23 cut by the cutter 32 is returned toward the upstream side over the cutter 32 by a small length (several millimeters). In this sense, the step S4 plays the role of reverse conveying means for rotating, when the cutter 32 is located at a position other than the reference positions, the roller pairs 28 and 29 such that the leading edge of the sheet 22 or 23 is returned to the position stated above.

After the step S4, the CPU 43 causes the cutter motor 34 to rotate in one direction for thereby moving the carrier 33 and therefore the cutter 32 to the right reference position (step S5). When the right sensor 41 senses the cutter 32 reached the right reference position and outputs an ON signal (YES, step S6), the CPU 43 causes the cutter motor 34 to stop rotating and thereby brings the cutter 32 to a stop (step S7). The steps S5 through S7 play the role of returning means for causing the cutter 32 to return to either one of the two reference positions after the reverse conveyance of the sheet 22 or 23.

If the answer of the step S3 is YES, meaning that the cutter 32 is located at the left reference position outside of the sheet conveyance range, then the CPU 43 does not move the cutter 32. On the other hand, if the answer of the step S2 is YES and if the left sensor 42 does not output an ON signal (NO, step S8), meaning that the cutter 32 is located at the right reference position outside of the sheet conveyance range, then the CPU 43 does not move the cutter 32.

Further, if the answers of the steps S2 and S8 both are YES, then the CPU 43 does not move the cutter 32, but executes cutter error processing, e.g., outputs an alarm message, because the cutter 32 never exists at both of the two reference positions at the same time. The alarm message may be displayed on a control panel, not shown, or output via a buzzer by way of example.

In summary, in accordance with the present invention, a sheet feeding device includes a cutter capable of being moved back and forth by hand between two reference positions outside of a sheet conveyance range. When the cutter is held in a halt at a position other than the reference positions, the sheet feeding device returns a sheet toward the upstream side by a preselected amount and then returns the cutter to one of the reference positions. Therefore, even when the cutter moved by hand for the replacement or the replenishment of a sheet is left in the sheet conveyance range, the cutter is prevented from again cutting the leading edge of the sheet when returning to the reference position. This protects the leading edge of the sheet from defective cutting.

Further, reverse conveying means and returning means assigned to the sheet and cutter, respectively, operate after a sheet storing section has been closed. Therefore, the sheet feeding device determines the stop position of the cutter every time the sheet storing section is closed, and automatically returns the cutter to the reference position if it is located at a position other than the reference positions.

Various modifications will become possible for those skilled in the art after receiving the teachings of the present disclosure without departing from the scope thereof.

What is claimed is:

1. A sheet feeding device comprising:

a sheet storing section configured to store an elongate sheet implemented as a roll;

an outlet via which the sheet paid out from said sheet storing section is conveyed to a preselected position;

feeding means for feeding the sheet via said outlet and driven by a reversible feed motor;

a cutter capable of being moved back and forth by hand between two reference positions located outside of and opposite sides of a widthwise range of the sheet;

a drive section that causes said cutter to move back and forth with power;

position recognizing means for recognizing a position where said cutter is held in a halt;

reverse conveying means for reverse conveying that causes said feeding means to return a leading edge of the sheet toward an upstream side in a direction of sheet feed over said cutter by a preselected amount when said position recognizing means determines that said cutter is not held in a halt at either of said two reference positions; and returning means for returning that causes said drive section to return said cutter to either one of said two reference positions after said reverse conveying means has returned the sheet when said position recognizing means determines that said cutter is not held in a halt at either of said two reference positions.

2. The device as claimed in claim 1, wherein said reverse conveying means and said returning means each perform a respective operation when said sheet storing section is closed.

3. In an image forming apparatus for forming an image on a sheet fed from a sheet feeding device, said sheet feeding device comprising:

a sheet storing section configured to store an elongate sheet implemented as a roll;

an outlet via which the sheet paid out from said sheet storing section is conveyed to a preselected position;

feeding means for feeding the sheet via said outlet and driven by a reversible feed motor;

a cutter capable of being moved back and forth by hand between two reference positions located outside of and opposite sides of a widthwise range of the sheet;

a drive section that causes said cutter to move back and forth with power;

position recognizing means for recognizing a position where said cutter is held in a halt;

reverse conveying means for reverse conveying that causes said feeding means to return a leading edge of the sheet toward an upstream side in a direction of sheet feed over said cutter by a preselected amount when said position recognizing means determines that said cutter is not held in a halt at either of said two reference positions; and returning means for returning that causes said drive section to return said cutter to either one of said two reference positions after said reverse conveying means has returned the sheet when said position recognizing means determines that said cutter is not held in a halt at either of said two reference positions.

4. A sheet feeding device comprising:

a sheet storing section configured to store an elongate sheet implemented as a roll;

an outlet via which the sheet paid out from said sheet storing section is conveyed to a preselected position;

a sheet feeder configured to feed the sheet via said outlet and driven by a reversible feed motor;

a cutter capable of being moved back and forth by hand between two reference positions located outside of and opposite sides of a widthwise range of the sheet;

a drive section that causes said cutter to move back and forth with power;

a position recognizer configured to recognize a position where said cutter is held in a halt;

a reverse conveyer configured to cause said sheet feeder to return a leading edge of the sheet toward an upstream side in a direction of sheet feed over said cutter by a preselected amount when said position recognizer determines that said cutter is not held in a halt at a either of said two reference positions; and a sheet returning device configured to cause said drive section to return said cutter to either one of said two reference positions after said reverse conveyer has returned the sheet when said position recognizer determines that said cutter is not held in a halt at either of said two reference positions.

5. The device as claimed in claim 4, wherein said reverse conveyer and said sheet returning device each perform a respective operation when said sheet storing section is closed.

* * * * *